US008102127B2

(12) United States Patent
Melanson

(10) Patent No.: US 8,102,127 B2
(45) Date of Patent: Jan. 24, 2012

(54) HYBRID GAS DISCHARGE LAMP-LED LIGHTING SYSTEM

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 1104 days.

(21) Appl. No.: 11/767,523

(22) Filed: Jun. 24, 2007

(65) Prior Publication Data

US 2008/0315791 A1 Dec. 25, 2008

(51) Int. Cl.
*H05B 35/00* (2006.01)

(52) U.S. Cl. ..... 315/178; 315/291; 315/360

(58) Field of Classification Search ..... 315/178, 315/246, 247, 250, 291, 307, 312, 324, 360
See application file for complete search history.

(56) References Cited

U.S. PATENT DOCUMENTS

| | | | | |
|---|---|---|---|---|
| 3,316,495 | A | 4/1967 | Sherer | |
| 3,423,689 | A | 1/1969 | Miller et al. | |
| 3,586,988 | A | 6/1971 | Weekes | |
| 3,725,804 | A | 4/1973 | Langan | |
| 3,790,878 | A | 2/1974 | Brokaw | |
| 3,881,167 | A | 4/1975 | Pelton et al. | |
| 4,075,701 | A | 2/1978 | Hofmann | |
| 4,334,250 | A | 6/1982 | Theus | |
| 4,414,493 | A | 11/1983 | Henrich | |
| 4,476,706 | A | 10/1984 | Hadden et al. | |
| 4,677,366 | A | 6/1987 | Wilkinson et al. | 323/222 |
| 4,683,529 | A | 7/1987 | Bucher | |
| 4,700,188 | A | 10/1987 | James | |
| 4,737,658 | A | 4/1988 | Kronmuller et al. | |
| 4,797,633 | A | 1/1989 | Humphrey | |
| 4,937,728 | A | 6/1990 | Leonardi | |
| 4,940,929 | A | 7/1990 | Williams | 323/222 |
| 4,973,919 | A | 11/1990 | Allfather | |

(Continued)

FOREIGN PATENT DOCUMENTS

EP 0585789 A1 3/1994

(Continued)

OTHER PUBLICATIONS

Freescale Semiconductor, Inc., Dimmable Light Ballast with Power Factor Correction, Design Reference Manual, DRM067, Rev. 1, Dec. 2005.

(Continued)

*Primary Examiner* — Thuy Vinh Tran
(74) *Attorney, Agent, or Firm* — Hamilton & Terrile, LLP; Kent B. Chambers

(57) ABSTRACT

A lighting system and method combine at least one LED and at least one gas discharge lamp within a common housing. The lighting system includes a control system to dependently operate each LED and each gas discharge lamp during overlapping, non-identical periods of time. In at least one embodiment, the control system can provide light output by activating LEDs during gas discharge preheating operations and thus extend the useful life of each gas discharge lamp. When dimming the lighting system, the control system can reduce current to the gas discharge lamps and one or more gas discharge lamps can be phased out as dimming levels decrease. As dimming levels decrease, one or more of the LEDs can be activated or groups of LEDs can be phased in to replace the light output of the dimmed gas discharge lamps. Thus, the lighting system can reduce power consumption at low dimming levels.

30 Claims, 5 Drawing Sheets

U.S. PATENT DOCUMENTS

| | | | | |
|---|---|---|---|---|
| 4,979,087 | A | 12/1990 | Sellwood et al. | |
| 4,980,898 | A | 12/1990 | Silvian | |
| 4,992,919 | A | 2/1991 | Lee et al. | |
| 4,994,952 | A | 2/1991 | Silva et al. | |
| 5,001,620 | A | 3/1991 | Smith | |
| 5,109,185 | A | 4/1992 | Ball | |
| 5,121,079 | A | 6/1992 | Dargatz | |
| 5,206,540 | A | 4/1993 | de Sa e Silva et al. | |
| 5,264,780 | A | 11/1993 | Bruer et al. | |
| 5,278,490 | A | 1/1994 | Smedley | |
| 5,323,157 | A | 6/1994 | Ledzius et al. | |
| 5,359,180 | A | 10/1994 | Park et al. | |
| 5,383,109 | A | 1/1995 | Maksimovic et al. | |
| 5,424,932 | A | 6/1995 | Inou et al. | |
| 5,477,481 | A | 12/1995 | Kerth | |
| 5,479,333 | A | 12/1995 | McCambridge et al. | |
| 5,481,178 | A | 1/1996 | Wilcox et al. | |
| 5,565,761 | A | 10/1996 | Hwang | |
| 5,589,759 | A | 12/1996 | Borgato et al. | |
| 5,638,265 | A | 6/1997 | Gabor | |
| 5,691,890 | A | 11/1997 | Hyde | |
| 5,747,977 | A | 5/1998 | Hwang | |
| 5,757,635 | A | 5/1998 | Seong | |
| 5,764,039 | A | 6/1998 | Choi et al. | |
| 5,781,040 | A | 7/1998 | Myers | |
| 5,783,909 | A | 7/1998 | Hochstein | |
| 5,798,635 | A | 8/1998 | Hwang et al. | |
| 5,900,683 | A | 5/1999 | Rinehart et al. | |
| 5,929,400 | A | 7/1999 | Colby et al. | |
| 5,946,202 | A | 8/1999 | Balogh | |
| 5,946,206 | A | 8/1999 | Shimizu et al. | |
| 5,952,849 | A | 9/1999 | Haigh et al. | |
| 5,960,207 | A | 9/1999 | Brown | |
| 5,963,086 | A | 10/1999 | Hall | |
| 5,966,297 | A | 10/1999 | Minegishi | |
| 5,994,885 | A | 11/1999 | Wilcox et al. | |
| 6,016,038 | A | 1/2000 | Mueller et al. | |
| 6,043,633 | A | 3/2000 | Lev et al. | |
| 6,072,969 | A | 6/2000 | Yokomori et al. | |
| 6,083,276 | A | 7/2000 | Davidson et al. | 717/1 |
| 6,084,450 | A | 7/2000 | Smith et al. | |
| 6,150,774 | A | 11/2000 | Mueller et al. | |
| 6,166,496 | A | 12/2000 | Lys et al. | |
| 6,181,114 | B1 | 1/2001 | Hemena et al. | |
| 6,211,626 | B1 | 4/2001 | Lys et al. | |
| 6,211,627 | B1 | 4/2001 | Callahan | |
| 6,229,271 | B1 | 5/2001 | Liu | |
| 6,229,292 | B1 | 5/2001 | Redl et al. | |
| 6,246,183 | B1 | 6/2001 | Buonavita | 315/248 |
| 6,259,614 | B1 | 7/2001 | Ribarich et al. | |
| 6,300,723 | B1 | 10/2001 | Wang et al. | |
| 6,304,066 | B1 | 10/2001 | Wilcox et al. | |
| 6,304,473 | B1 | 10/2001 | Telefus et al. | |
| 6,340,868 | B1 | 1/2002 | Lys et al. | |
| 6,343,026 | B1 | 1/2002 | Perry | |
| 6,344,811 | B1 | 2/2002 | Melanson | |
| 6,385,063 | B1 | 5/2002 | Sadek et al. | |
| 6,407,691 | B1 | 6/2002 | Yu | |
| 6,441,558 | B1 | 8/2002 | Muthu et al. | |
| 6,445,600 | B2 | 9/2002 | Ben-Yaakov | |
| 6,452,521 | B1 | 9/2002 | Wang | |
| 6,459,919 | B1 | 10/2002 | Lys et al. | |
| 6,469,484 | B2 | 10/2002 | L'Hermite et al. | |
| 6,495,964 | B1 | 12/2002 | Muthu et al. | |
| 6,509,913 | B2 | 1/2003 | Martin, Jr. et al. | 345/762 |
| 6,528,954 | B1 | 3/2003 | Lys et al. | |
| 6,548,967 | B1 | 4/2003 | Dowling et al. | |
| 6,577,080 | B2 | 6/2003 | Lys et al. | |
| 6,580,258 | B2 | 6/2003 | Wilcox et al. | |
| 6,583,550 | B2 | 6/2003 | Iwasa et al. | 313/485 |
| 6,624,597 | B2 | 9/2003 | Dowling et al. | |
| 6,628,106 | B1 | 9/2003 | Batarseh et al. | |
| 6,636,003 | B2 | 10/2003 | Rahm et al. | 315/179 |
| 6,646,848 | B2 | 11/2003 | Yoshida et al. | |
| 6,688,753 | B2 * | 2/2004 | Calon et al. | 362/236 |
| 6,713,974 | B2 | 3/2004 | Patchornik et al. | 315/295 |
| 6,717,376 | B2 | 4/2004 | Lys et al. | |
| 6,724,174 | B1 | 4/2004 | Esteves et al. | |
| 6,727,832 | B1 | 4/2004 | Melanson | |
| 6,737,845 | B2 | 5/2004 | Hwang | |
| 6,741,123 | B1 | 5/2004 | Andersen et al. | |
| 6,753,661 | B2 | 6/2004 | Muthu et al. | |
| 6,756,772 | B2 | 6/2004 | McGinnis | |
| 6,768,655 | B1 | 7/2004 | Yang et al. | |
| 6,774,584 | B2 | 8/2004 | Lys et al. | |
| 6,777,891 | B2 | 8/2004 | Lys et al. | |
| 6,781,329 | B2 | 8/2004 | Mueller et al. | |
| 6,781,351 | B2 | 8/2004 | Mednik et al. | 323/222 |
| 6,788,011 | B2 | 9/2004 | Mueller et al. | |
| 6,806,659 | B1 | 10/2004 | Mueller et al. | 315/295 |
| 6,839,247 | B1 | 1/2005 | Yang | |
| 6,860,628 | B2 | 3/2005 | Robertson et al. | 362/555 |
| 6,869,204 | B2 | 3/2005 | Morgan et al. | |
| 6,870,325 | B2 | 3/2005 | Bushell et al. | |
| 6,873,065 | B2 | 3/2005 | Haigh et al. | |
| 6,882,552 | B2 | 4/2005 | Telefus et al. | |
| 6,888,322 | B2 | 5/2005 | Dowling et al. | |
| 6,894,471 | B2 | 5/2005 | Corva et al. | |
| 6,897,624 | B2 | 5/2005 | Lys et al. | |
| 6,933,706 | B2 | 8/2005 | Shih | |
| 6,936,978 | B2 | 8/2005 | Morgan et al. | |
| 6,940,733 | B2 | 9/2005 | Schie et al. | 363/21.12 |
| 6,944,034 | B1 | 9/2005 | Shytenberg et al. | |
| 6,956,750 | B1 | 10/2005 | Eason et al. | |
| 6,958,920 | B2 | 10/2005 | Mednik et al. | |
| 6,963,496 | B2 | 11/2005 | Bimbaud | |
| 6,965,205 | B2 | 11/2005 | Piepgras et al. | |
| 6,967,448 | B2 | 11/2005 | Morgan et al. | |
| 6,969,954 | B2 | 11/2005 | Lys | |
| 6,970,503 | B1 | 11/2005 | Kalb | |
| 6,975,079 | B2 | 12/2005 | Lys et al. | |
| 6,975,523 | B2 | 12/2005 | Kim et al. | |
| 6,980,446 | B2 | 12/2005 | Simada et al. | |
| 7,003,023 | B2 | 2/2006 | Krone et al. | |
| 7,014,336 | B1 | 3/2006 | Ducharme et al. | |
| 7,034,611 | B2 | 4/2006 | Oswal et al. | |
| 7,038,398 | B1 | 5/2006 | Lys et al. | |
| 7,038,399 | B2 | 5/2006 | Lys et al. | |
| 7,042,172 | B2 | 5/2006 | Dowling et al. | |
| 7,050,509 | B2 | 5/2006 | Krone et al. | |
| 7,064,498 | B2 | 6/2006 | Dowling et al. | |
| 7,064,531 | B1 | 6/2006 | Zinn | |
| 7,075,329 | B2 | 7/2006 | Chen et al. | |
| 7,078,963 | B1 | 7/2006 | Andersen et al. | |
| 7,088,059 | B2 | 8/2006 | McKinney et al. | |
| 7,102,902 | B1 | 9/2006 | Brown et al. | 363/89 |
| 7,106,603 | B1 | 9/2006 | Lin et al. | |
| 7,109,791 | B1 | 9/2006 | Epperson et al. | |
| 7,113,541 | B1 | 9/2006 | Lys et al. | |
| 7,126,288 | B2 | 10/2006 | Ribarich et al. | |
| 7,135,824 | B2 | 11/2006 | Lys et al. | |
| 7,139,617 | B1 | 11/2006 | Morgan et al. | |
| 7,145,295 | B1 | 12/2006 | Lee et al. | |
| 7,158,633 | B1 | 1/2007 | Hein | |
| 7,161,311 | B2 | 1/2007 | Mueller et al. | |
| 7,161,313 | B2 | 1/2007 | Piepgras et al. | |
| 7,161,556 | B2 | 1/2007 | Morgan et al. | |
| 7,161,816 | B2 | 1/2007 | Shytenberg et al. | |
| 7,180,252 | B2 | 2/2007 | Lys et al. | |
| 7,183,957 | B1 | 2/2007 | Melanson | |
| 7,186,003 | B2 | 3/2007 | Dowling et al. | |
| 7,187,141 | B2 | 3/2007 | Mueller et al. | |
| 7,202,613 | B2 | 4/2007 | Morgan et al. | |
| 7,221,104 | B2 | 5/2007 | Lys et al. | |
| 7,221,130 | B2 | 5/2007 | Ribeiro et al. | |
| 7,233,115 | B2 | 6/2007 | Lys | |
| 7,233,135 | B2 | 6/2007 | Noma et al. | |
| 7,242,152 | B2 | 7/2007 | Dowling et al. | |
| 7,246,919 | B2 * | 7/2007 | Porchia et al. | 362/276 |
| 7,248,239 | B2 | 7/2007 | Dowling et al. | |
| 7,253,566 | B2 | 8/2007 | Lys et al. | |
| 7,255,457 | B2 | 8/2007 | Ducharme et al. | |
| 7,256,554 | B2 | 8/2007 | Lys | |
| 7,266,001 | B1 | 9/2007 | Notohamiprodjo et al. | |
| 7,274,160 | B2 | 9/2007 | Mueller et al. | |
| 7,288,902 | B1 * | 10/2007 | Melanson | 315/291 |
| 7,292,013 | B1 | 11/2007 | Chen et al. | |

| | | | | |
|---|---|---|---|---|
| 7,300,192 | B2 | 11/2007 | Mueller et al. | |
| 7,308,296 | B2 | 12/2007 | Lys et al. | |
| 7,309,965 | B2 | 12/2007 | Dowling et al. | |
| 7,310,244 | B2 | 12/2007 | Yang et al. | |
| 7,345,458 | B2 | 3/2008 | Kanai et al. | |
| 7,375,476 | B2 * | 5/2008 | Walter et al. | 315/312 |
| 7,388,764 | B2 | 6/2008 | Huynh et al. | |
| 7,394,210 | B2 | 7/2008 | Ashdown | |
| 7,511,437 | B2 | 3/2009 | Lys et al. | |
| 7,538,499 | B2 | 5/2009 | Ashdown | |
| 7,545,130 | B2 | 6/2009 | Latham | |
| 7,554,473 | B2 | 6/2009 | Melanson | |
| 7,569,996 | B2 | 8/2009 | Holmes et al. | |
| 7,583,136 | B2 | 9/2009 | Pelly | |
| 7,656,103 | B2 | 2/2010 | Shteynberg et al. | |
| 7,710,047 | B2 | 5/2010 | Shteynberg et al. | |
| 7,719,248 | B1 | 5/2010 | Melanson | |
| 7,746,043 | B2 | 6/2010 | Melanson | |
| 7,746,671 | B2 | 6/2010 | Radecker et al. | |
| 7,750,738 | B2 | 7/2010 | Bach | |
| 7,804,256 | B2 | 9/2010 | Melanson | |
| 7,804,480 | B2 * | 9/2010 | Jeon et al. | 345/102 |
| 2002/0145041 | A1 | 10/2002 | Muthu et al. | |
| 2002/0150151 | A1 | 10/2002 | Krone et al. | |
| 2002/0166073 | A1 | 11/2002 | Nguyen et al. | |
| 2003/0095013 | A1 | 5/2003 | Melanson et al. | |
| 2003/0174520 | A1 | 9/2003 | Bimbaud | |
| 2003/0223255 | A1 | 12/2003 | Ben-Yaakov | |
| 2004/0004465 | A1 | 1/2004 | McGinnis | |
| 2004/0046683 | A1 | 3/2004 | Mitamura et al. | |
| 2004/0085030 | A1 | 5/2004 | Laflamme et al. | |
| 2004/0085117 | A1 | 5/2004 | Melbert et al. | |
| 2004/0169477 | A1 | 9/2004 | Yanai et al. | |
| 2004/0227571 | A1 | 11/2004 | Kuribayashi | |
| 2004/0228116 | A1 | 11/2004 | Miller et al. | |
| 2004/0232971 | A1 | 11/2004 | Kawasaki et al. | |
| 2004/0239262 | A1 | 12/2004 | Ido et al. | |
| 2005/0057237 | A1 | 3/2005 | Clavel | |
| 2005/0156770 | A1 | 7/2005 | Melanson | |
| 2005/0168492 | A1 | 8/2005 | Hekstra et al. | |
| 2005/0184895 | A1 | 8/2005 | Petersen et al. | |
| 2005/0207190 | A1 | 9/2005 | Gritter | |
| 2005/0218838 | A1 | 10/2005 | Lys | |
| 2005/0253533 | A1 | 11/2005 | Lys et al. | |
| 2005/0270813 | A1 | 12/2005 | Zhang et al. | |
| 2005/0275354 | A1 | 12/2005 | Hausman, Jr. et al. | 315/291 |
| 2005/0275386 | A1 | 12/2005 | Jepsen et al. | |
| 2006/0022916 | A1 | 2/2006 | Aiello | |
| 2006/0023002 | A1 | 2/2006 | Hara et al. | |
| 2006/0125420 | A1 | 6/2006 | Boone et al. | |
| 2006/0214603 | A1 | 9/2006 | Oh et al. | |
| 2006/0226795 | A1 | 10/2006 | Walter et al. | |
| 2006/0238136 | A1 * | 10/2006 | Johnson, III et al. | 315/185 R |
| 2006/0261754 | A1 | 11/2006 | Lee | |
| 2006/0285365 | A1 | 12/2006 | Huynh et al. | |
| 2007/0024213 | A1 | 2/2007 | Shteynberg et al. | |
| 2007/0029946 | A1 | 2/2007 | Yu et al. | |
| 2007/0040512 | A1 | 2/2007 | Jungwirth et al. | |
| 2007/0053182 | A1 | 3/2007 | Robertson | 362/228 |
| 2007/0103949 | A1 | 5/2007 | Tsuruya | |
| 2007/0124615 | A1 | 5/2007 | Orr | |
| 2007/0182699 | A1 | 8/2007 | Ha et al. | |
| 2008/0012502 | A1 | 1/2008 | Lys | |
| 2008/0043504 | A1 | 2/2008 | Ye et al. | |
| 2008/0054815 | A1 | 3/2008 | Kotikalapoodi et al. | |
| 2008/0130322 | A1 | 6/2008 | Artusi et al. | |
| 2008/0174291 | A1 | 7/2008 | Hansson et al. | |
| 2008/0174372 | A1 | 7/2008 | Tucker et al. | |
| 2008/0175029 | A1 | 7/2008 | Jung et al. | |
| 2008/0192509 | A1 | 8/2008 | Dhuyvetter et al. | |
| 2008/0224635 | A1 | 9/2008 | Hayes | |
| 2008/0232141 | A1 | 9/2008 | Artusi et al. | |
| 2008/0239764 | A1 | 10/2008 | Jacques et al. | |
| 2008/0259655 | A1 | 10/2008 | Wei et al. | |
| 2008/0278132 | A1 | 11/2008 | Kesterson et al. | |
| 2009/0067204 | A1 | 3/2009 | Ye et al. | |
| 2009/0147544 | A1 | 6/2009 | Melanson | |
| 2009/0174479 | A1 | 7/2009 | Yan et al. | |
| 2009/0218960 | A1 | 9/2009 | Lyons et al. | |

FOREIGN PATENT DOCUMENTS

| | | | |
|---|---|---|---|
| EP | 0910168 | A1 | 4/1999 |
| EP | 1014563 | | 6/2000 |
| EP | 1164819 | A | 12/2001 |
| EP | 1213823 | A2 | 6/2002 |
| EP | 1528785 | A | 5/2005 |
| EP | 2204905 | A1 | 7/2010 |
| GB | 2069269 | A | 8/1981 |
| WO | 01/15316 | A1 | 1/2001 |
| WO | 01/97384 | A | 12/2001 |
| WO | 02/15386 | A2 | 2/2002 |
| WO | 0227944 | | 4/2002 |
| WO | 02/091805 | A2 | 11/2002 |
| WO | WO 2006/022107 | A2 | 3/2006 |
| WO | 2006/067521 | A | 6/2006 |
| WO | W02006135584 | | 12/2006 |
| WO | 2007/026170 | A | 3/2007 |
| WO | 2007/079362 | A | 7/2007 |

OTHER PUBLICATIONS

J. Zhou et al., Novel Sampling Algorithm for DSP Controlled 2 kW PFC Converter, IEEE Transactions on Power Electronics, vol. 16, No. 2, Mar. 2001.

A. Prodic, Compensator Design and Stability Assessment for Fast Voltage Loops of Power Factor Correction Rectifiers, IEEE Transactions on Power Electronics, vol. 22, No. 5, Sep. 2007.

M. Brkovic et al., "Automatic Current Shaper with Fast Output Regulation and Soft-Switching," S.15.C Power Converters, Telecommunications Energy Conference, 1993.

Dallas Semiconductor, Maxim, "Charge-Pump and Step-Up DC-DC Converter Solutions for Powering White LEDs in Series or Parallel Connections," Apr. 23, 2002.

Freescale Semiconductor, AN3052, Implementing PFC Average Current Mode Control Using the MC9S12E128, Nov. 2005.

D. Maksimovic et al., "Switching Converters with Wide DC Conversion Range," Institute of Electrical and Electronic Engineer's (IEEE) Transactions on Power Electronics, Jan. 1991.

V. Nguyen et al., "Tracking Control of Buck Converter Using Sliding-Mode with Adaptive Hysteresis," Power Electronics Specialists Conference, 1995. PESC apos; 95 Record., 26th Annual IEEE vol. 2, Issue , Jun. 18-22, 1995 pp. 1086-1093.

S. Zhou et al., "A High Efficiency, Soft Switching DC-DC Converter with Adaptive Current-Ripple Control for Portable Applications," IEEE Transactions on Circuits and Systems—II: Express Briefs, vol. 53, No. 4, Apr. 2006.

K. Leung et al., "Use of State Trajectory Prediction in Hysteresis Control for Achieving Fast Transient Response of the Buck Converter," Circuits and Systems, 2003. ISCAS apos;03. Proceedings of the 2003 International Symposium, vol. 3, Issue , May 25-28, 2003 pp. III-439-III-442 vol. 3.

K. Leung et al., "Dynamic Hysteresis Band Control of the Buck Converter with Fast Transient Response," IEEE Transactions on Circuits and Systems—II: Express Briefs, vol. 52, No. 7, Jul. 2005.

Y. Ohno, Spectral Design Considerations for White LED Color Rendering, Final Manuscript, Optical Engineering, vol. 44, 111302 (2005).

S. Skogstad et al., A Proposed Stability Characterization and Verification Method for High-Order Single-Bit Delta-Sigma Modulators, Norchip Conference, Nov. 2006 http://folk.uio.no/sayskogs/pub/A_Proposed_Stability_Characterization.pdf.

J. Turchi, Four Keys Steps to Design a Continuous Conduction Mode PFC Stage Using the NCP1653, ON Semiconductor, Publication Order No. AND184/D, Nov. 2004.

Megaman, D or S Dimming ESL, Product News, Mar. 15, 2007.

J. Qian et al., New Charge Pump Power-Factor-Correction Electronic Ballast with a Wide Range of Line Input Voltage, IEEE Transactions on Power Electronics, vol. 14, No. 1, Jan. 1999.

P. Green, A Ballast that can be Dimmed from a Domestic (Phase-Cut) Dimmer, IRPLCFL3 rev. b, International Rectifier, http://www.irf.com/technical-info/refdesigns/cfl-3.pdf, printed Mar. 24, 2007.

J. Qian et al., Charge Pump Power-Factor-Correction Technologies Part II: Ballast Applications, IEEE Transactions on Power Electronics, vol. 15, No. 1, Jan. 2000.

Chromacity Shifts in High-Power White LED Systems due to Different Dimming Methods, Solid-State Lighting, http://www.lrc.rpi.edu/programs/solidstate/completedProjects.asp?ID=76, printed May 3, 2007.
S. Chan et al., Design and Implementation of Dimmable Electronic Ballast Based on Integrated Inductor, IEEE Transactions on Power Electronics, vol. 22, No. 1, Jan. 2007.
M. Madigan et al., Integrated High-Quality Rectifier-Regulators, IEEE Transactions on Industrial Electronics, vol. 46, No. 4, Aug. 1999.
T. Wu et al., Single-Stage Electronic Ballast with Dimming Feature and Unity Power Factor, IEEE Transactions on Power Electronics, vol. 13, No. 3, May 1998.
F. Tao et al., "Single-Stage Power-Factor-Correction Electronic Ballast with a Wide Continuous Dimming Control for Fluorescent Lamps," IEEE Power Electronics Specialists Conference, vol. 2, 2001.
AZOTEQ, IQS17 Family, IQ Switch®—ProxSense™ Series, Touch Sensor, Load Control and User Interface, IQS17 Datasheet V2.00.doc, Jan. 2007.
C. Dilouie, Introducing the LED Driver, EC&M, Sep. 2004.
S. Lee et al., TRIAC Dimmable Ballast with Power Equalization, IEEE Transactions on Power Electronics, vol. 20, No. 6, Nov. 2005.
L. Gonthier et al., EN55015 Compliant 500W Dimmer with Low-Losses Symmetrical Switches, 2005 European Conference on Power Electronics and Applications, Sep. 2005.
D. Hausman, Real-Time Illumination Stability Systems for Trailing-Edge (Reverse Phase Control) Dimmers, Technical White Paper, Lutron, version 1.0, Dec. 2004, http://www.lutron.com/technical_info/pdf/RTISS-TE.pdf.
Light Dimmer Circuits, www.epanorama.net/documents/lights/lightdimmer.html, printed Mar. 26, 2007.
Light Emitting Diode, http://en.wikipedia.org/wiki/Light-emitting_diode, printed Mar. 27, 2007.
Color Temperature, www.sizes.com/units/color_temperature.htm, printed Mar. 27, 2007.
S. Lee et al., A Novel Electrode Power Profiler for Dimmable Ballasts Using DC Link Voltage and Switching Frequency Controls, IEEE Transactions on Power Electronics, vol. 19, No. 3, May 2004.
Y. Ji et al., Compatibility Testing of Fluorescent Lamp and Ballast Systems, IEEE Transactions on Industry Applications, vol. 35, No. 6, Nov./Dec. 1999.
National Lighting Product Information Program, Specifier Reports, "Dimming Electronic Ballasts," vol. 7, No. 3, Oct. 1999.
Supertex Inc., Buck-based LED Drivers Using the HV9910B, Application Note AN-H48, Dec. 28, 2007.
D. Rand et al., Issues, Models and Solutions for Triac Modulated Phase Dimming of LED Lamps, Power Electronics Specialists Conference, 2007.
Supertex Inc., HV9931 Unity Power Factor LED Lamp Driver, Application Note AN-H52, Mar. 7, 2007.
Supertex Inc., 56W Off-line LED Driver, 120VAC with PFC, 160V, 350mA Load, Dimmer Switch Compatible, DN-H05, Feb. 2007.
ST Microelectronics, Power Factor Corrector L6561, Jun. 2004.
Fairchild Semiconductor, Application Note 42047 Power Factor Correction (PFC) Basics, Rev. 0.9.0 Aug. 19, 2004.
M. Radecker et al., Application of Single-Transistor Smart-Power IC for Fluorescent Lamp Ballast, Thirty-Fourth Annual Industry Applications Conference IEEE, vol. 1, Oct. 3, 1999-Oct. 7, 1999.
M. Rico-Secades et al., Low Cost Electronic Ballast for a 36-W Fluorescent Lamp Based on a Current-Mode-Controlled Boost Inverter for a 120-V DC Bus Power Distribution, IEEE Transactions on Power Electronics, vol. 21, No. 4, Jul. 2006.
Fairchild Semiconductor, FAN4800, Low Start-up Current PFC/PWM Controller Combos, Nov. 2006.
Fairchild Semiconductor, FAN4810, Power Factor Correction Controller, Sep. 24, 2003.
Fairchild Semiconductor, FAN4822, ZVS Average Current PFC Controller, Aug. 10, 2001.
Fairchild Semiconductor, FAN7527B, Power Factor Correction Controller, 2003.
Fairchild Semiconductor, ML4821, Power Factor Controller, Jun. 19, 2001.
Freescale Semiconductor, AN1965, Design of Indirect Power Factor Correction Using 56F800/E, Jul. 2005.
International Search Report for PCT/US2008/051072, mailed Jun. 4, 2008.
Infineon, CCM-PFC Standalone Power Factor Correction (PFC) Controller in Continuous Conduction Mode (CCM), Version 2.1, Feb. 6, 2007.
International Rectifier, IRAC1150-300W Demo Board, User's Guide, Rev 3.0, Aug. 2, 2005.
International Rectifier, Application Note AN-1077,PFC Converter Design with IR1150 One Cycle Control IC, rev. 2.3, Jun. 2005.
International Rectifier, Data Sheet PD60230 revC, Feb. 5, 2007.
Lu et al, International Rectifier, Bridgeless PFC Implementation Using One Cycle Control Technique, 2005.
Linear Technology, LT1248, Power Factor Controller, Apr. 20, 2007.
On Semiconductor, AND8123/D, Power Factor Correction Stages Operating in Critical Conduction Mode, Sep. 2003.
On Semiconductor, MC33260, GreenLine Compact Power Factor Controller: Innovative Circuit for Cost Effective Solutions, Sep. 2005.
On Semiconductor, NCP1605, Enhanced, High Voltage and Efficient Standby Mode, Power Factor Controller, Feb. 2007.
On Semconductor, NCP1606, Cost Effective Power Factor Controller, Mar. 2007.
On Semiconductor, NCP1654, Product Review, Power Factor Controller for Compact and Robust, Continuous Conduction Mode Pre-Converters, Mar. 2007.
Philips, Application Note, 90W Resonant SMPS with TEA1610 SwingChip, AN99011, 1999.
NXP, TEA1750, GreenChip III SMPS control IC Product Data Sheet, Apr. 6, 2007.
Renesas, HA16174P/FP, Power Factor Correction Controller IC, Jan. 6, 2006.
Renesas Technology Releases Industry's First Critical-Conduction-Mode Power Factor Correction Control IC Implementing Interleaved Operation, Dec. 18, 2006.
Renesas, Application Note R2A20111 EVB, PFC Control IC R2A20111 Evaluation Board, Feb. 2007.
STMicroelectronics, L6563, Advanced Transition-Mode PFC Controller, Mar. 2007.
Texas Instruments, Application Note SLUA321, Startup Current Transient of the Leading Edge Triggered PFC Controllers, Jul. 2004.
Texas Instruments, Application Report, SLUA309A, Avoiding Audible Noise at Light Loads when using Leading Edge Triggered PFC Converters, Sep. 2004.
Texas Instruments, Application Report SLUA369B, 350-W, Two-Phase Interleaved PFC Pre-Regulator Design Review, Mar. 2007.
Unitrode, High Power-Factor Preregulator, Oct. 1994.
Texas Instruments, Transition Mode PFC Controller, SLUS515D, Jul. 2005.
Unitrode Products From Texas Instruments, Programmable Output Power Factor Preregulator, Dec. 2004.
Unitrode Products From Texas Instruments, High Performance Power Factor Preregulator, Oct. 2005.
Texas Instruments, UCC3817 BiCMOS Power Factor Preregulator Evaluation Board User's Guide, Nov. 2002.
Unitrode, L. Balogh, Design Note UC3854A/B and UC3855A/B Provide Power Limiting with Sinusoidal Input Current for PFC Front Ends, SLUA196A, Nov. 2001.
A. Silva de Morais et al., A High Power Factor Ballast Using a Single Switch with Both Power Stages Integrated, IEEE Transactions on Power Electronics, vol. 21, No. 2, Mar. 2006.
M. Ponce et al., High-Efficient Integrated Electronic Ballast for Compact Fluorescent Lamps, IEEE Transactions on Power Electronics, vol. 21, No. 2, Mar. 2006.
A. R. Seidel et al., A Practical Comparison Among High-Power-Factor Electronic Ballasts with Similar Ideas, IEEE Transactions on Industry Applications, vol. 41, No. 6, Nov.-Dec. 2005.
F. T. Wakabayashi et al, An Improved Design Procedure for LCC Resonant Filter of Dimmable Electronic Ballasts for Fluorescent Lamps, Based on Lamp Model, IEEE Transactions on Power Electronics, vol. 20, No. 2, Sep. 2005.

J. A. Vilela Jr. et al., An Electronic Ballast with High Power Factor and Low Voltage Stress, IEEE Transactions on Industry Applications, vol. 41, No. 4, Jul./Aug. 2005.
S. T.S. Lee et al., Use of Saturable Inductor to Improve the Dimming Characteristics of Frequency-Controlled Dimmable Electronic Ballasts, IEEE Transactions on Power Electronics, vol. 19, No. 6, Nov. 2004.
M. K. Kazimierczuk et al., Electronic Ballast for Fluorescent Lamps, IEEETransactions on Power Electronics, vol. 8, No. 4, Oct. 1993.
S. Ben-Yaakov et al., Statics and Dynamics of Fluorescent Lamps Operating at High Frequency: Modeling and Simulation, IEEE Transactions on Industry Applications, vol. 38, No. 6, Nov.-Dec. 2002.
H. L. Cheng et al., A Novel Single-Stage High-Power-Factor Electronic Ballast with Symmetrical Topology, IEEE Transactions on Power Electronics, vol. 50, No. 4, Aug. 2003.
J.W.F. Dorleijn et al., Standardisation of the Static Resistances of Fluorescent Lamp Cathodes and New Data for Preheating, Industry Applications Conference, vol. 1, Oct. 13, 2002-Oct. 18, 2002.
Q. Li et al., An Analysis of the ZVS Two-Inductor Boost Converter under Variable Frequency Operation, IEEE Transactions on Power Electronics, vol. 22, No. 1, Jan. 2007.
H. Peng et al., Modeling of Quantization Effects in Digitally Controlled DC-DC Converters, IEEE Transactions on Power Electronics, vol. 22, No. 1, Jan. 2007.
G. Yao et al., Soft Switching Circuit for Interleaved Boost Converters, IEEE Transactions on Power Electronics, vol. 22, No. 1, Jan. 2007.
C. M. de Oliviera Stein et al., A ZCT Auxiliary Communication Circuit for Interleaved Boost Converters Operating in Critical Conduction Mode, IEEE Transactions on Power Electronics, vol. 17, No. 6, Nov. 2002.
W. Zhang et al., A New Duty Cycle Control Strategy for Power Factor Correction and FPGA Implementation, IEEE Transactions on Power Electronics, vol. 21, No. 6, Nov. 2006.
H. Wu et al., Single Phase Three-Level Power Factor Correction Circuit with Passive Lossless Snubber, IEEE Transactions on Power Electronics, vol. 17, No. 2, Mar. 2006.
O. Garcia et al., High Efficiency PFC Converter to Meet EN61000-3-2 and A14, Proceedings of the 2002 IEEE International Symposium on Industrial Electronics, vol. 3, 2002.
P. Lee et al., Steady-State Analysis of an Interleaved Boost Converter with Coupled Inductors, IEEE Transactions on Industrial Electronics, vol. 47, No. 4, Aug. 2000.
D.K.W. Cheng et al., A New Improved Boost Converter with Ripple Free Input Current Using Coupled Inductors, Power Electronics and Variable Speed Drives, Sep. 21-23, 1998.
B.A. Miwa et al., High Efficiency Power Factor Correction Using Interleaved Techniques, Applied Power Electronics Conference and Exposition, Seventh Annual Conference Proceedings, Feb. 23-27, 1992.
Z. Lai et al., A Family of Power-Factor-Correction Controllers, Twelfth Annual Applied Power Electronics Conference and Exposition, vol. 1, Feb. 23, 1997-Feb. 27, 1997.
L. Balogh et al., Power-Factor Correction with Interleaved Boost Converters in Continuous-Inductor-Current Mode, Eighth Annual Applied Power Electronics Conference and Exposition, 1993. APEC '93. Conference Proceedings, Mar. 7, 1993-Mar. 11, 1993.
Fairchild Semiconductor, Application Note 42030, Theory and Application of the ML4821 Average Current Mode PFC Controller, Oct. 25, 2000.
Unitrode Products From Texas Instruments, BiCMOS Power Factor Preregulator, Feb. 2006.
D. Hausman, Lutron, RTISS-TE Operation, Real-Time Illumination Stability Systems for Trailing-Edge (Reverse Phase Control) Dimmers, v. 1.0 Dec. 2004.
International Rectifier, Data Sheet No. PD60230 revC, IR1150(S)(PbF), uPFC One Cycle Control PFC IC Feb. 5, 2007.
Texas Instruments, Application Report SLUA308, UCC3817 Current Sense Transformer Evaluation, Feb. 2004.
Texas Instruments, Applicantion Report SPRA902A, Average Current Mode Controlled Power Factor Correctiom Converting using TMS320LF2407A, Jul. 2005.
Unitrode, Design Note DN-39E, Optimizing Performance in UC3854 Power Factor Correction Applications, Nov. 1994.
Fairchild Semiconductor, Application Note 42030, Theory and Application of the ML4821 Average Currrent Mode PFCController, Aug. 1997.
Fairchild Semiconductor, Application Note AN4121, Design of Power Factor Correction Circuit Using FAN7527B, Rev. 1.0.1, May 30, 2002.
Fairchild Semiconductor, Application Note 6004, 500W Power-Factor-Corrected (PFC) Converter Design with FAN4810, Rev. 1.0.1, Oct. 31, 2003.
Fairchild Semiconductor, FAN4822, ZVA Average Current PFC Controller, Rev. 1.0.1 Aug. 10, 2001.
Fairchild Semiconductor, ML4821, Power Factor Controller, Rev. 1.0.2, Jun. 19, 2001.
Fairchild Semiconductor, ML4812, Power Factor Controller, Rev. 1.0.4, May 31, 2001.
Linear Technology, 100 Watt LED Driver, undated.
Fairchild Semiconductor, FAN7544, Simple Ballast Controller, Rev. 1.0.0.
Fairchild Semiconductor, FAN7532, Ballast Controller, Rev. 1.0.2.
Fairchild Semiconductor, FAN7711, Ballast Control IC, Rev. 1.0.2.
Fairchild Semiconductor, KA7541, Simple Ballast Controller, Rev. 1.0.3.
ST Microelectronics, L6574, CFL/TL Ballast Driver Preheat and Dimming, Sep. 2003.
ST Microelectronics, AN993, Application Note, Electronic Ballast with PFC Using L6574 and L6561, May 2004.
"Chromaticity Shifts in High-Power White LED Systems due to Different Dimming Methods," Solid-State Lighting, http://www.lre.rpi.edu/programs/solidstate/completedProjects.asp?ID=76, printed May 3, 2007.
"Color Temperature," www.sizes.com/units/color_temperature.htm, printed Mar. 27, 2007.
"Light Dimmer Circuits," www.epanorama.net/documents/lights/lightdimmer.html, printed Mar. 26, 2007.
"Light Emitting Diode," http://en.wikipedia.org/wiki/Light-emitting_diode, printed Mar. 27, 2007.
Azoteq, "IQS17 Family, IQ Switch®—ProxSense™ Series, Touch Sensor, Load Control and User Interface," IQS17 Datasheet V2.00.doc, Jan. 2007.
DiLouie, "Introducing the LED Driver," EC&M, Sep. 2004.
D. Hausman, "Real-Time Illumination Stability Systems for Trailing-Edge (Reverse Phase Control) Dimmers," Technical White Paper, Lutron, version 1.0, Dec. 2004, http://www.lutron.com/technical_info/pdf/RTISS-TE.pdf.
Freescale Semiconductor, "Dimmable Light Ballast with Power Factor Correction," Designer Reference Manual, M68HC08 Microcontrollers, DRM067, Rev. 1, Dec. 2005.
J. Qian et al., "Charge Pump Power-Factor-Correction Technologies Part II: Ballast Applications," IEEE Transactions on Power Electronics, vol. 15, No. 1, Jan. 2000.
J. Qian et al., "New Charge Pump Power-Factor-Correction Electronic Ballast with a Wide Range of Line Input Voltage," IEEE Transactions on Power Electronics, vol. 14, No. 1, Jan. 1999.
L. Gonthier et al., "EN55015 Compliant 500W Dimmer with Low-Losses Symmetrical Switches," 2005 European Conference on Power Electronics and Applications, Sep. 2005.
M. Madigan et al., "Integrated High-Quality Rectifier-Regulators," IEEE Transactions on Industrial Electronics, vol. 46, No. 4, Aug. 1999.
P. Green, "A Ballast that can be Dimmed from a Domestic (Phase-Cut) Dimmer," IRPLCFL3 rev. b, International Rectifier, http://www.irf.com/technical-info/refdesigns/cfl-3.pdf, printed Mar. 24, 2007.
S. Chan et al., "Design and Implementation of Dimmable Electronic Ballast Based on Integrated Inductor," IEEE Transactions on Power Electronics, vol. 22, No. 1, Jan. 2007.
S. Lee et al., "A Novel Electrode Power Profiler for Dimmable Ballasts Using DC Link Voltage and Switching Frequency Controls," IEEE Transactions on Power Electronics, vol. 19, No. 3, May 2004.
S. Lee et al., "TRIAC Dimmable Ballast with Power Equalization," IEEE Transactions on Power Electronics, vol. 20, No. 6, Nov. 2005.

Wu et al., "Single-Stage Electronic Ballast with Dimming Feature and Unity Power Factor," IEEE Transactions on Power Electronics, vol. 13, No. 3, May 1998.
Y. Ji et al., "Compatibility Testing of Fluorescent Lamp and Ballast Systems," IEEE Transactions on Industry Applications, vol. 35, No. 6, Nov./Dec. 1999.
International Search Report and Written Opinion for PCT/US2008/062384 dated Jan. 14, 2008.
S. Dunlap et al., Design of Delta-Sigma Modulated Switching Power Supply, Circuits & Systems, Proceedings of the 1998 IEEE International Symposium, 1998.
Mamano, Bob, "Current Sensing Solutions for Power Supply Designers", Unitrode Seminar Notes SEM1200, 1999.
http://toolbarpdf.com/docs/functions-and-features-of-inverters.html printed on Jan. 20, 2011.
"HV9931 Unity Power Factor LED Lamp Driver, Initial Release", Supertex Inc., Sunnyvale, CA USA 2005.
AN-H52 Application Note: "HV9931 Unity Power Factor LED Lamp Driver" Mar. 7, 2007, Supertex Inc., Sunnyvale, CA, USA.
Dustin Rand et al: "Issues, Models and Solutions for Triac Modulated Phase Dimming of LED Lamps" Power Electronics Specialists Conferrence, 2007. PESC 2007. IEEE, IEEE, P1, Jun. 1, 2007, pp. 1398-1404.
Spiazzi G et al: "Analysis of a High-Power Factor Electronic Ballast for High Brightness Light Emitting Diodes" Power Electronics Specialists, 2005 IEEE 36TH Conference on Jun. 12, 2005, Piscatawa, NJ, USA, IEEE, pp. 1494-1499.
International Search Report PCT/US2008/062381 dated Feb. 5, 2008.
International Search Report PCT/US2008/056739 dated Dec. 3, 2008.
Written Opinion of the International Searching Authority PCT/US2008/062381 dated Feb. 5, 2008.
Ben-Yaakov et al, "The Dynamics of a PWM Boost Converter with Resistive Input" IEEE Transactions on Industrial Electronics, IEEE Service Center, Piscataway, NJ, USA, vol. 46, No. 3, Jun. 1, 1999.
International Search Report PCT/US2008/062398 dated Feb. 5, 2008.
Partial International Search Report PCT/US2008/062387 dated Feb. 5, 2008.
Noon, Jim "UC3855A/B High Performance Power Factor Preregulator", Texas Instruments, SLUA146A, May 1996, Revised Apr. 2004.
International Search Report PCT/GB2006/003259 dated Jan. 12, 2007.
Written Opinion of the International Searching Authority PCT/US2008/056739 dated Dec. 3, 2008.
International Search Report PCT/US2008/056606 dated Dec. 3, 2008.
Written Opinion of the International Searching Authority PCT/US2008/056606 dated Dec. 3, 2008.
International Search Report PCT/US2008/056608 dated Dec. 3, 2008.
Written Opinion of the International Searching Authority PCT/US2008/056608 dated Dec. 3, 2008.
International Search Report PCT/GB2005/050228 dated Mar. 14, 2006.
International Search Report PCT/US2008/062387 dated Jan. 10, 2008.
Data Sheet LT3496 Triple Output LED Driver, Linear Technology Corporation, Milpitas, CA 2007.
Linear Technology, News Release,Triple Output LED, LT3496, Linear Technology, Milpitas, CA, May 24, 2007.
Texas Instruments, Interleaving Continuous Conduction Mode PFC Controller, UCC28070, SLUS794C, Nov. 2007, revised Jun. 2009, Texas Instruments, Dallas TX.
ST Datasheet L6562, Transition-Mode PFC Controller, 2005, STMicroelectronics, Geneva, Switzerland.
Maksimovic, Regan Zane and Robert Erickson, Impact of Digital Control in Power Electronics, Proceedings of 2004 International Symposium on Power Semiconductor Devices & Ics, Kitakyushu, Apr. 5, 2010, Colorado Power Electronics Center, ECE Department, University of Colorado, Boulder, CO.
Power Integrations, Inc., "TOP200-4/14 TOPSwitch Family Three-terminal Off-line PWM Switch", XP-002524650, Jul. 1996, Sunnyvale, California.
Texas Instruments, SLOS318F, "High-Speed, Low Noise, Fully-Differential I/O Amplifiers," THS4130 and THS4131, US, Jan. 2006.
Hirota, Atsushi et al, "Analysis of Single Switch Delta-Sigma Modulated Pulse Space Modulation PFC Converter Effectively Using Switching Power Device," IEEE, US, 2002.
Prodic, Aleksandar, "Digital Controller for High-Frequency Rectifiers with Power Factor Correction Suitable for On-Chip Implementation," IEEE, US, 2007.
Erickson, Robert W. et al, "Fundamentals of Power Electronics," Second Edition, Chapter 6, Boulder, CO, 2001.
Allegro Microsystems, A1442, "Low Voltage Full Bridge Brushless DC Motor Driver with Hall Commutation and Soft-Switching, and Reverse Battery, Short Circuit, and Thermal Shutdown Protection," Worcester MA, 2009.
Texas Instruments, SLUS828B, "8-Pin Continuous Conduction Mode (CCM) PFC Controller", UCC28019A, US, revised Apr. 2009.
Analog Devices, "120 kHz Bandwidth, Low Distortion, Isolation Amplifier", AD215, Norwood, MA, 1996.
Burr-Brown, ISO120 and ISO121, "Precision Los Cost Isolation Amplifier," Tucson AZ, Mar. 1992.
Burr-Brown, ISO130, "High IMR, Low Cost Isolation Amplifier," SBOS220, US, Oct. 2001.
Prodic, A. et al, "Dead Zone Digital Controller for Improved Dynamic Response of Power Factor Preregulators," IEEE, 2003.
Linear Technology, "Single Switch PWM Controller with Auxiliary Boost Converter," LT1950 Datasheet, Linear Technology, Inc., Milpitas, CA, 2003.
Yu, Zhenyu, 3.3V DSP for Digital Motor Control, Texas Instruments, Application Report SPRA550 dated Jun. 1999.
International Rectifier, Data Sheet No. PD60143-O, Current Sensing Single Channel Driver, El Segundo, CA, dated Sep. 8, 2004.

* cited by examiner

HYBRID GAS DISCHARGE LAMP-LED LIGHTING SYSTEM

BACKGROUND OF THE INVENTION

1. Field of the Invention

The present invention relates in general to the field of lighting, and more specifically to a hybrid gas discharge lamp-led lighting system and method.

2. Description of the Related Art

Commercially practical incandescent light bulbs have been available for over 100 years. However, other light sources show promise as commercially viable alternatives to the incandescent light bulb. Gas discharge light sources (such as fluorescent, mercury vapor, low pressure sodium) and high pressure sodium lamps and light emitting diode (LED), represent two categories of light source alternatives to incandescent lamps. LEDs are becoming particularly attractive as main stream light sources in part because of energy savings through high efficiency light output and environmental incentives such as the reduction of mercury.

Incandescent lamps generate light by passing current through a filament located within a vacuum chamber. The current causes the filament to heat and produce light. The filament produces more heat as more current passes through the filament. For a clear vacuum chamber, the temperature of the filament determines the color of the light. A lower temperature results in yellowish tinted light and a high temperature results in a bluer, whiter light.

Gas discharge lamps include a housing that encloses gas. For a typical hot-cathode bulb, the housing is terminated by two filaments. The filaments are pre-heated during a pre-heat period, and then a high voltage is applied across the tube. An arc is created in the ionized gas to produce light. Once the arc is created, the resistance of the lamp decreases. A ballast regulates the current supplied to the lamp. Fluorescent lamps are common form of a gas discharge lamp. Fluorescent lamps contain mercury vapor and produce ultraviolet light. The housing interior of the fluorescent lamps include a phosphor coating to convert the ultraviolet light into visible light.

LEDs are semiconductor devices and are driven by direct current. The lumen output intensity (i.e. brightness) of the LED varies approximately in direct proportion to the current flowing through the LED. Thus, increasing current supplied to an LED increases the intensity of the LED, and decreasing current supplied to the LED dims the LED. Current can be modified by either directly reducing the direct current level to the LEDs or by reducing the average current through pulse width modulation.

Instantly starting gas discharge lamps, such as fluorescent lamps, without sufficiently pre-heating filaments of the lamps can reduce lamp life. To increase lamp life, ballasts preheat gas discharge lamp filaments for a period of time. The amount of preheat time varies and is, for example, between 0.5 seconds and 2.0 seconds for fluorescent lamps. Generally, longer preheat times result in longer lamp life. However, when a light fixture is turned 'on', users generally desire near instantaneous illumination.

FIG. 1 depicts a light-power graph 100 comparing relative light output versus active power for a fluorescent lamp dimming ballast. A fluorescent lamp can be dimmed by reducing the amount of current supplied to the lamp. Fluorescent lamps are not 100% efficient due to, for example, the heating of lamp filaments, which converts some drive current into heat rather than light. At low dimming levels, the inefficiencies of fluorescent lamps are particularly notable. For example, if 70 watts are used to generate 100% light output (point 102) and an average of 17 watts of power are used to generate 5% relative light output (point 104), when dimming from 100% light output to 5% light output, the ratio of Watts/Light Output increases from 0.7 to approx. 3.4.

SUMMARY OF THE INVENTION

In one embodiment of the present invention, a hybrid gas discharge lamp-light emitting diode (LED) lighting system includes a housing, an LED retained by the housing, and a gas discharge lamp retained by the housing. The system further includes a control system coupled to the LED and the gas discharge lamp to dependently operate the LED and gas discharge lamp during overlapping, non-identical periods of time.

In another embodiment of the present invention, a lighting system control system to control a hybrid gas discharge lamp-light emitting diode (LED) lighting system includes a first output to provide an LED control signal and a second output to provide a gas discharge lamp control signal. The control system also includes circuitry to dependently operate at least one LED and at least one gas discharge lamp during overlapping, non-identical periods of time.

In a further embodiment of the present invention, a method of controlling a hybrid gas discharge lamp-light emitting diode (LED) includes supplying a control signal to a control system configured to control operation of an LED and a gas discharge lamp retained by a housing. The method further includes operating the LED and gas discharge lamp dependently during overlapping, non-identical periods of time.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A lighting system and method combine at least one light emitting diode (LED) and at least one gas discharge lamp within a common housing. The lighting system includes a control system to dependently operate each LED and each gas discharge lamp during overlapping, non-identical periods of time. Thus, in at least one embodiment, the control system can instantaneously provide light output while extending the useful life of each gas discharge lamp and reducing power consumption at low dimming levels. In at least one embodiment, when the lighting system is turned 'on', the control system can activate one or more of the LEDs while preheating the gas discharge lamp. Thus, each activated LED provides light output prior to generation of light output by the gas discharge lamp. Upon completion of lamp preheating, one or more of the LEDs can remain ON or be deactivated. When the lighting system is dimmed, current to the gas discharge lamps can be decreased and one or more gas discharge lamps can be phased out as dimming levels decrease. As dimming levels decrease, the control system can activate one or more of the LEDs or groups of LEDs can be phased in to replace the light output of the dimmed gas discharge lamps. Thus, the lighting system can extend the useful life of each gas discharge lamp and reduce power consumption at low dimming levels.

The lighting system can use a combination of LEDs and gas discharge lamps in a light fixture to achieve lower costs relative to light fixtures that use only LEDs, increase the life span of the light fixture, and provide improved light output and energy savings during activation of the light fixture and at various dimming levels. The cost of LEDs/lumen output is currently greater than the cost of many gas discharge lights/lumen. For example, for the same cost, a consumer can purchase a fluorescent lamp that produces more light than an LED or set of LEDs that produces the same amount of light. However, LEDs have some advantages over gas discharge lights. For example, LEDs are more efficient than gas discharge lights when dimmed, i.e. LEDs provide more light output for the same amount of power, and the operational life span of LEDs typically exceeds the operational life span of gas discharge lamps, particularly fluorescent lamps.

The lighting system also includes a control system that dependently operates LED(s) and gas discharge lamp(s) in a light fixture to leverage the advantages of the LED(s) and gas discharge lamp(s).

Figure 1:
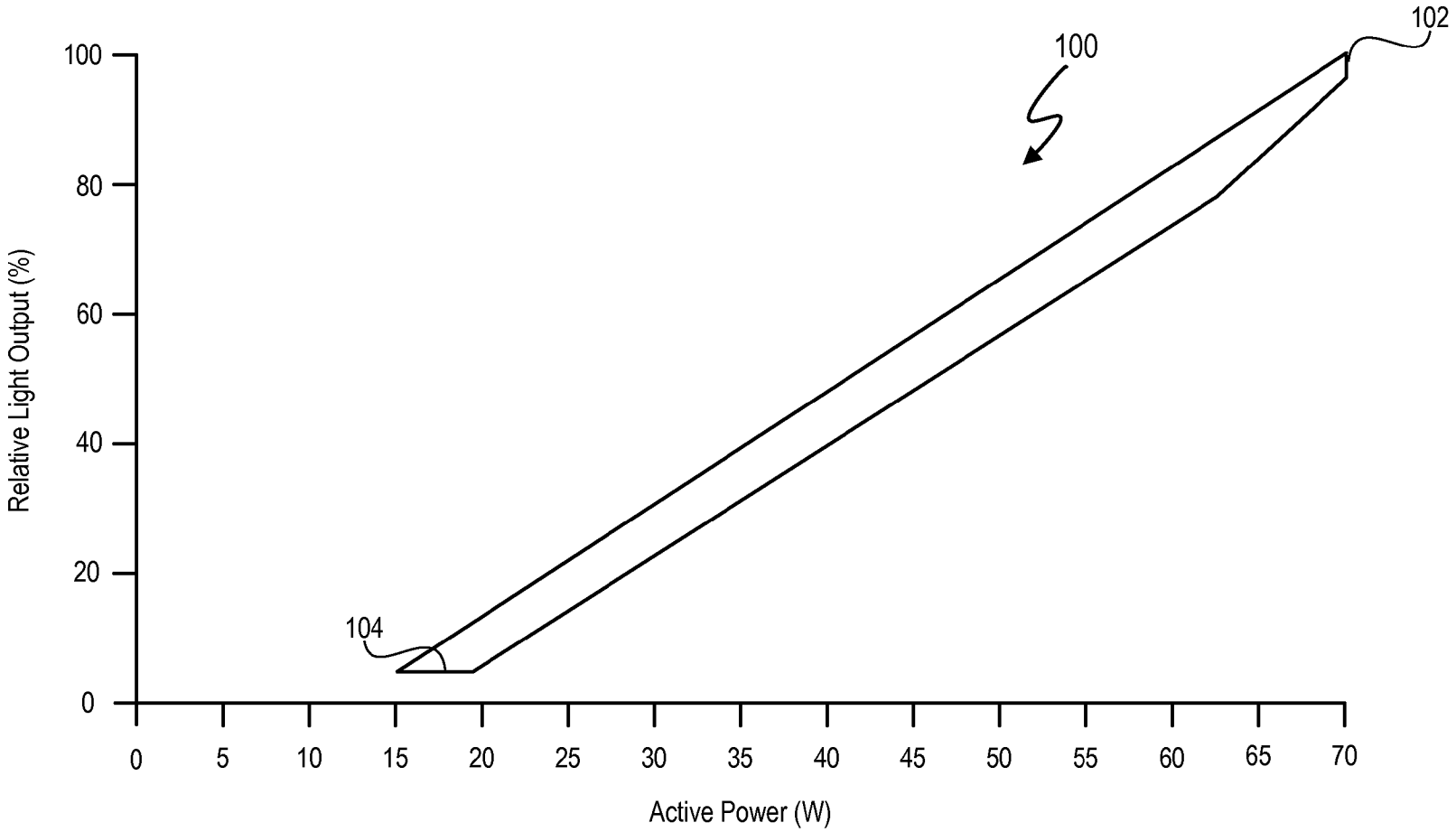
FIGURE 1 (prior art)
FIG. 1 (labeled prior art) depicts a light-power graph comparing relative light output versus active power for a fluorescent lamp.
Figure 2:
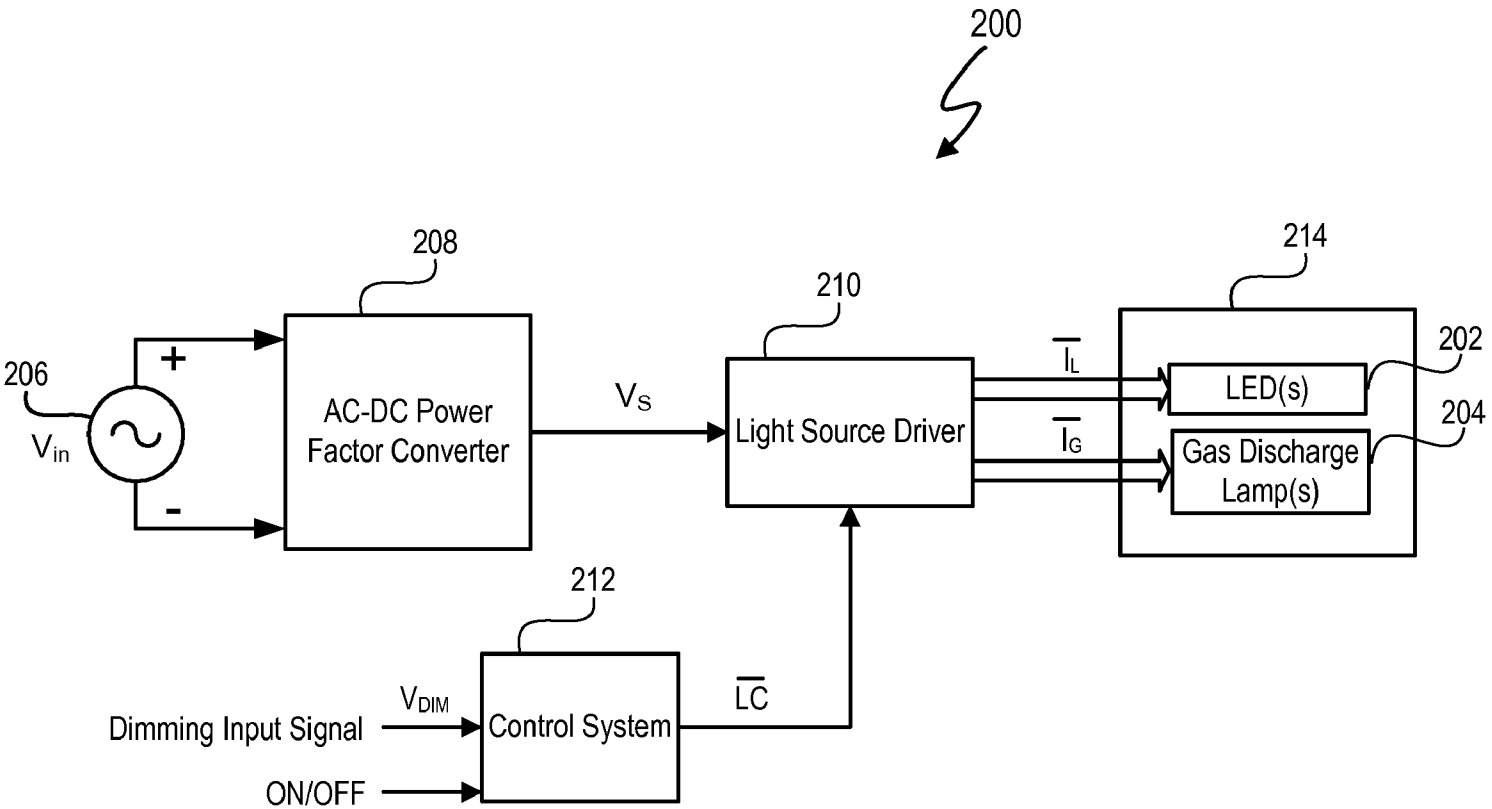
FIG. 2 depicts a block diagram of an exemplary lighting system that controls the light output of one or more light emitting diodes (LEDs) and one or more gas discharge lamps.

FIG. 2 depicts an exemplary lighting system 200 that controls the light output of each LED 202 and gas discharge lamp 204 of light fixture 214. An alternating current (AC) source 206 provides an input voltage $V_{in}$ to an AC-direct current (DC) power factor converter 208. In at least one embodiment, the input voltage $V_{in}$ is a 110-120 VAC, 60 Hz line voltage. In another embodiment, the input voltage $V_{in}$ is a duty cycle modified dimmer circuit output voltage. Any input voltage and frequency can be used. AC-DC power converter 208 can be any AC-DC power converter, such as the exemplary AC-DC power converter described in U.S. Provisional Patent Application Ser. No. 60/909,458, entitled "Ballast for Light Emitting Diode Light Sources", filed on Apr. 1, 2007, inventor John L. Melanson. The AC-DC power converter 208 converts the line voltage $V_{in}$ into a steady state voltage $V_S$ and supplies the steady voltage $V_S$ to light source driver 210. The light source driver 210 provides a current drive signal $\bar{I}_L$ to LED(s) 202 and a current drive signal $\bar{I}_G$ to gas discharge lamp(s) 204. Increasing current to the LED(s) 202 and gas discharge lamp(s) 204 increases the intensity of the LED(s) 202 and gas discharge lamp(s) 204. Conversely, decreasing current to the LED(s) 202 and gas discharge lamp(s) 204 decreases the intensity of the LED(s) 202 and gas discharge lamp(s) 204.

Current drive signal $\bar{I}_L$ is a vector that can include a single current drive signal for all LED(s) 202 or can be a set N+1 of current drive signals, $\{I_{L0}, I_{L1}, \ldots I_{LN}\}$, that drive individual LEDs and or subsets of LEDs. N+1 is an integer greater than or equal to 1 and, in at least one embodiment, equals the number LED(s) 202. Current drive signal $\bar{I}_G$ is also vector that can include a single current drive signal for all gas discharge lamp(s) 202 or can be a set M+1 of current drive signals, $\{I_{L0}, I_{L1}, I_{LM}\}$, that drive individual LEDs and or subsets of LEDs. M+1 is also an integer greater than or equal to 1, and, in at least one embodiment, represents the number gas discharge lamp(s) 202. The Melanson patents also describe exemplary systems for generating current drive signals.

The control system 212 dependently operates each LED 202 and each gas discharge lamp 204 during overlapping, non-identical periods of time. Non-identical periods of time means time periods that have different start times and/or different end times but do not have the same start times and same end times. Overlapping periods of time means that the periods of time co-exist for a duration of time. Control system 212 can be implemented using, for example, integrated circuit based logic, discrete logic components, software, and/or firmware. Control system 212 receives a dimming input signal $V_{DIM}$. Dimming input signal $V_{DIM}$ can be any digital or analog signal generated by a dimmer system (not shown). The dimming input signal $V_{DIM}$ represents a selected dimming level ranging from 100% dimming to 0% dimming. A 100% dimming level represents no light output, and a 0% dimming level representing full light output (i.e. no dimming). In at least one embodiment, the dimming input signal $V_{DIM}$ is the input voltage $V_{in}$. U.S. Provisional Patent Application Ser. No. 60/909,458, entitled "Ballast for Light Emitting Diode Light Sources", filed on Apr. 1, 2007, inventor John L. Melanson, U.S. patent application Ser. No. 11/695,023, entitled "Color Variations in a Dimmable Lighting Device with Stable Color Temperature Light Sources", filed on Apr. 1, 2007, inventor John L. Melanson, U.S. Provisional Patent Application Ser. No. 60/909,457, entitled "Multi-Function Duty Cycle Modifier", filed on Apr. 1, 2007, inventors John L. Melanson and John J. Paulos, and U.S. patent application Ser. No. 11/695,024, entitled "Lighting System with Lighting Dimmer Output Mapping", filed on Apr. 1, 2007, inventors John L. Melanson and John J. Paulos, all commonly assigned to Cirrus Logic, Inc. and collectively referred to as the "Melanson patents", describe exemplary systems for detecting the dimming level indicated by the dimming signal $V_{DIM}$. The Melanson patents are hereby incorporated by reference in their entireties.

Control system 212 can also receive a separate ON/OFF signal indicating that the light fixture 214 should be turned ON or OFF. In another embodiment, a 0% dimming input signal $V_{DIM}$ indicates ON, and a 100% dimming input signal $V_{DIM}$ indicates OFF.

The control system 212 provides a light source control signal $\overline{LC}$ to light source driver 210. The light source driver 210 responds to the light source control signal $\overline{LC}$ by supplying current drive signals $\bar{I}_L$ and $\bar{I}_G$ that cause the respective LED(s) 202 and gas discharge lamp(s) 204 to operate in accordance with the light source control signal $\overline{LC}$. The light source control signal $\overline{LC}$ can be, for example, a vector with light control signal elements $LC_0, LC_1, \ldots, LC_{M+N+2}$ for controlling (i) each of the LED(s) 202 and gas discharge lamp(s), (ii) a vector with control signals for groups of the LED(s) 202 and/or gas discharge lamp(s) 204, or (iii) a single coded signal that indicates a light output percentage for the LED(s) 202 and gas discharge lamp(s) 204. The light source control signal $\overline{LC}$ can be provided via a single conductive path (such as a wire or etch run) or multiple conductive paths for each individual control signal.

In at least one embodiment, the control system 212 dependently operates each LED and each gas discharge lamp during overlapping, non-identical periods of time. In at least one embodiment, the light fixture 214 is OFF (i.e. all light sources in light fixture 214 are OFF), and the control system 212 receives a signal to turn the light fixture 214 ON. To provide an instantaneous light output response, the control system 212 supplies a control signal $\overline{LC}$ to light source driver 210 requesting activation of LED(s) 202 (i.e. turned ON) and requesting preheating of the filaments of gas discharge lamp(s) 204. The light source driver 210 responds by supplying a current drive signal $I_L$ to the LED(s) 202 to activate the LED(s) 202 and supplying a current drive signal $I_G$ to the gas discharge lamp(s) 204 to preheat the filaments of the gas discharge lamp(s) 204. The particular values of current drive signals $I_L$ and $I_G$ depend upon the current-to-light output characteristics of the light fixture 214 and particular dimming levels requested by control system 212.

The LED(s) 202 can be overdriven to provide greater initial light output, especially prior to the gas discharge lamp(s) 205 providing full intensity light. "Overdriven" refers to providing a current drive signal $I_L$ that exceeds the manufacturer's maximum recommended current drive signal for the LED(s) 202. The LED(s) 202 can be overdriven for a short amount of time, e.g. 2-10 seconds, without significantly degrading the operational life of the LED(s) 202. By overdriving the LED(s) 202, fewer LED(s) 202 can be included in light fixture 214 while providing the same light output as a larger number of LED(s) operated within a manufacturer's maximum operating recommendations. The number of LED(s) 202 is a matter of design choice and depends upon the maximum amount of desired illumination from the LED(s). Because the human eye adapts to low light levels, the perceived light output of the LED(s) will be greater than the actual light output if the human eye has adapted to a low light level. It has been determined that having 10%-20% of the output light power immediately available is effective in providing the appearance of "instant on."

When the lighting system is dimmed, current to the gas discharge lamps can be decreased and one or more gas discharge lamps can be phased out as dimming levels decrease. In at least one embodiment, as dimming levels decrease and current is decreased to the gas discharge lamps, the control system 212, with no more than an insubstantial delay, e.g. (no more than 3 seconds), can activate one or more of the LEDs, or the control system 212 can phase in groups of LEDs to replace the light output of the dimmed gas discharge lamps.

Figure 3:
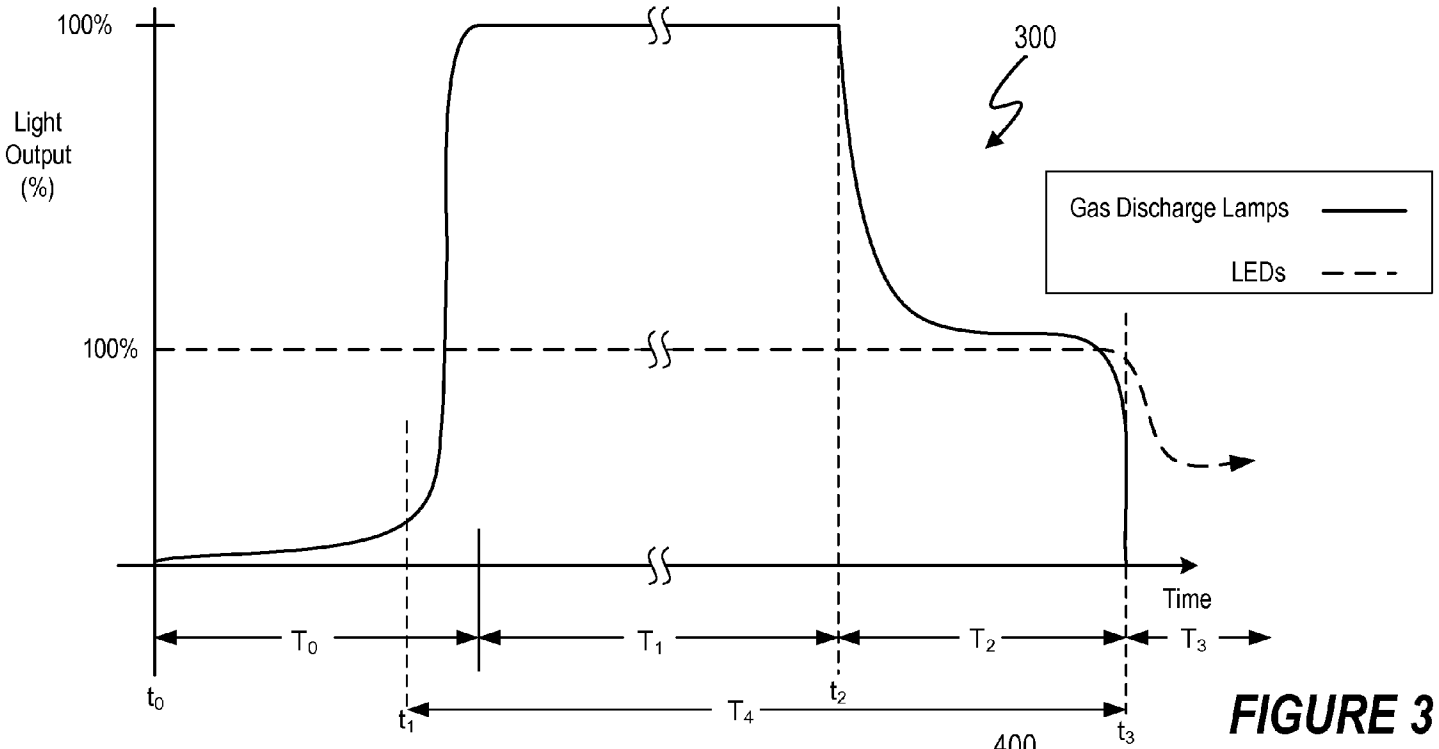
FIG. 3 depicts an LED-gas discharge lamp coordination graph.

FIG. 3 depicts an exemplary LED-gas discharge lamp coordination graph 300 for LED(s) 202 and gas discharge lamp(s) during overlapping, non-identical periods of time. In the embodiment of FIG. 3, control system 212 receives an activation ON/OFF signal at the start of time period $t_0$, with dimming input signal $V_{DIM}$ indicating 100% intensity during time periods $T_0$ and $T_1$, 50% intensity during time period $T_2$, and 10% intensity during time period $T_3$.

At time $t_0$, the beginning of time period $T_0$, control system 212 provides a control signal $\overline{LC}$ to light source driver 210 requesting light source driver 210 to activate the LED(s) 202. Light source driver 210 responds by activating LED(s) 202 with a current drive signal $I_L$ that produces at least 100% output of the LED(s) 202. During time period $T_0$, control system 212 provides a control signal $\overline{LC}$ to light source driver 210 requesting light source driver 210 to warm the filaments of gas discharge lamp(s) 204. Light source driver 210 responds by providing a current drive signal $I_G$ to warm the filaments of gas discharge lamp(s) 204.

At time $t_1$, the filaments of gas discharge lamp(s) 204 have been sufficiently warmed to extend the life of the lamp(s) 204, and control system 212 provides a light control signal $\overline{LC}$ to light source driver 210 requesting light source driver 210 continue activation of LED(s) 202 and provide a current signal $I_L$ to gas discharge lamp(s) 204 to cause gas discharge lamp(s) 204 to provide 100% light output. During time period $T_1$, the gas discharge lamp(s) 204 are fully ON and the LED(s) 202 are ON.

At time $t_2$, the beginning of time period $T_2$, the dimming input signal $V_{DIM}$ indicates 50% light intensity. The control system 212 can dim light fixture 214 in a number of ways by, for example, dimming individual LED(s) 202 and gas discharge lamp(s) 204, dimming subsets of the LED(s) 202 and gas discharge lamp(s) 204, or dimming gas discharge lamp(s) 204 and increasing current supplied to the LED(s) 202. In at least one embodiment, the subsets are proper subsets, i.e. a proper subset of a set of elements contains fewer elements than the set. The selected dimming levels can range from 100% to 0% by, for example, turning different combinations of the LED(s) 202 and gas discharge lamp(s) 204 ON and OFF. In the embodiment of graph 300, control system 212 provides light control signal $\overline{LC}$ to light source driver 210 requesting deactivation of two of three gas discharge lamps 204 and dimming of all LED(s) 202 to achieve a 50% dimming level for light fixture 214.

At time $t_3$, the beginning of time period $T_3$, the dimming input signal $V_{DIM}$ indicates 10% dimming. In at least one embodiment, to maximize energy efficiency, at time $t_3$ control system 212 provides light control signal $\overline{LC}$ to light source driver 210 requesting deactivation of all gas discharge lamps 204 and dimming of all LED(s) 202 to achieve a 10% dimming level for light fixture 214. Table 1 contains exemplary dependent combinations of LED(s) 202 and gas discharge lamp(s) 204 for exemplary dimming levels. Thus, the LED(s) 202 are ON during time periods $T_1$-$T_3$, and the gas discharge lamps 204 are ON during overlapping, non-identical time period $T_4$.

TABLE 1

| Dimming Level (DL) | LED(s) 202 | Gas Discharge Lamp(s) 204 |
|---|---|---|
| 50% ≦ DL ≦ 100% | All LED(s) ON with appropriate dimming | All Lamp(s) ON with appropriate dimming |
| 10% ≦ DL < 50% | All LED(s) ON with appropriate dimming | One Lamp ON with appropriate dimming, all others OFF. |
| 0% < DL ≦ 10% | All LED(s) ON with appropriate dimming | All Lamps OFF |

The exact numbers of LED(s) 202 and gas discharge lamp(s) and coordination of dimming, activation, and deactivation of the LED(s) 202 and gas discharge lamp(s) 204 to achieve desired dimming levels and life spans of the light fixture 214 are matters of design choice. Additionally, the light fixture 214 can be initially activated at a dimming level between 0 and 100% by initially dimming the LED(s) 202 and/or the gas discharge lamp(s) 204.

Figure 4:
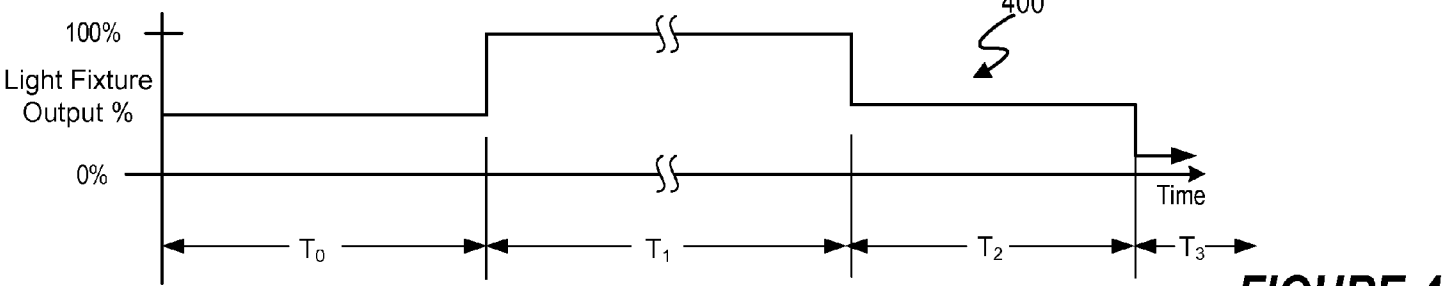
FIG. 4 depicts a light fixture output graph that generally correlates in time with the LED-gas discharge lamp coordination graph of FIG. 3.

FIG. 4 depicts a light fixture output graph 400 that generally correlates in time with the LED-gas discharge lamp coordination graph 300. Light fixture output graph 400 depicts the overall light output of light fixture 214 resulting from the coordination of LED(s) 202 and gas discharge lamp(s) 204 by control system 212 during overlapping, non-identical periods of time.

Figure 5:
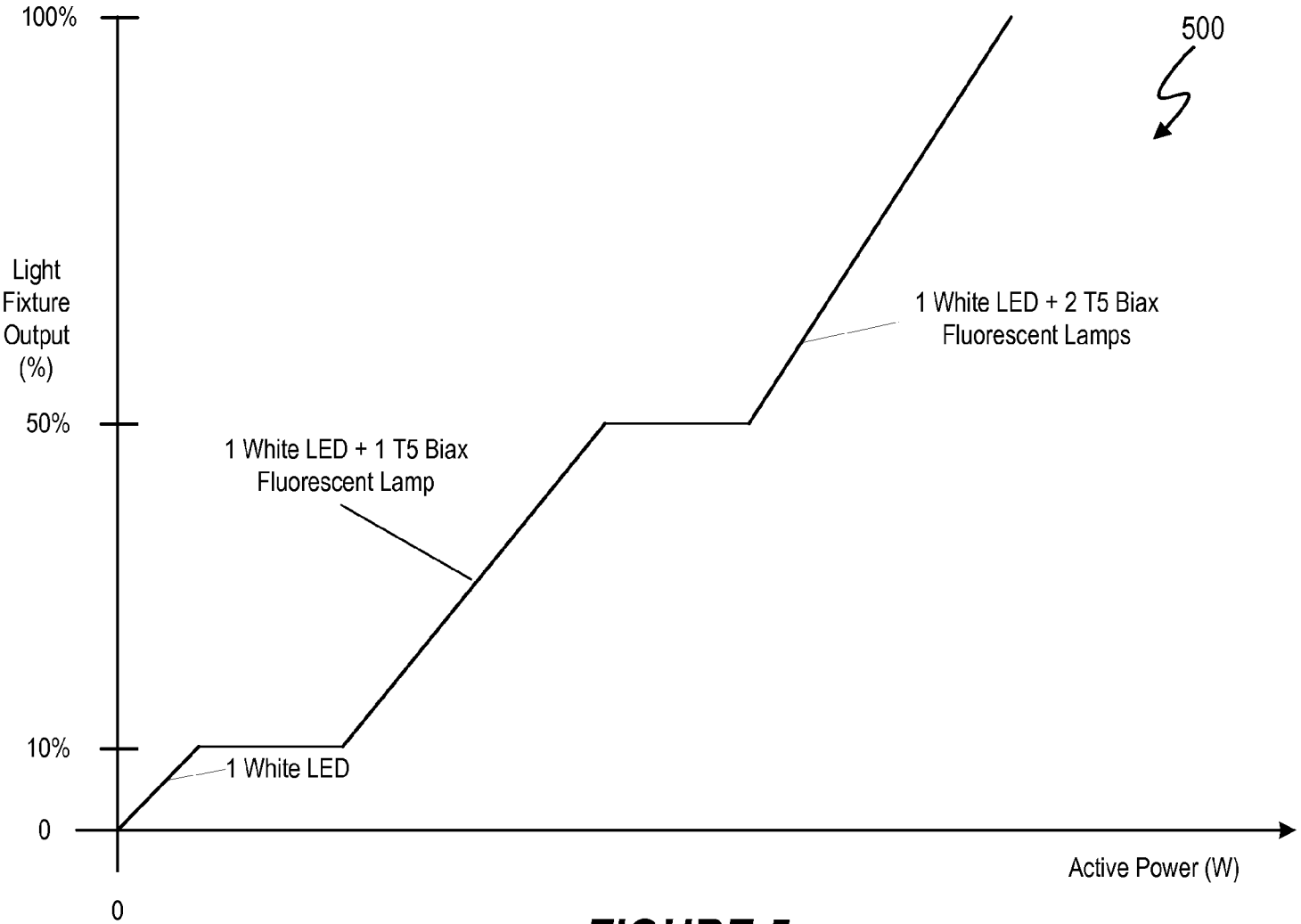
FIG. 5 depicts a graph that shows light fixture output percentages versus consumed power for various combinations of LEDs and fluorescent gas discharge lamps.

FIG. 5 depicts a light output-power graph 500 that represents exemplary light fixture output percentages versus consumed power for one white LED and 2 T5 biax fluorescent lamps. With only the LED activated and light output dimmed between 0 and 10%, the light fixture 212 operates efficiently by converting nearly all power into light. Activating one of the T5 biax fluorescent lamps reduces efficiency because, for example, some drive current is converted into heat to heat the filaments of the fluorescent lamp. However, efficiency improves as light fixture output levels increase between 10% and 50%. Activating both fluorescent lamps and deactivating the LED for light fixture output levels varying between 50% and 100% results in improved efficiency for the LED-fluorescent lamps combination. Thus, dependent control of the LED-fluorescent lamp configuration improves efficiency compared to using only fluorescent lamps and also achieves lighting intensity levels using fewer LEDs compared to using an identical number of LEDs only.

Figure 6:
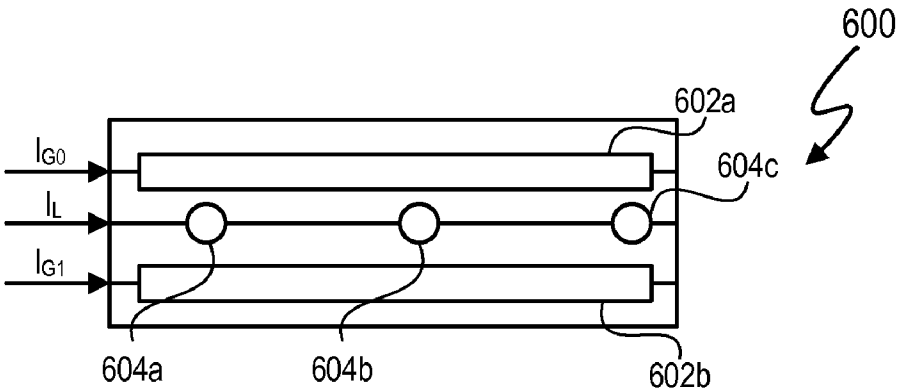
FIGS. 6 and 7 depict respective exemplary lighting fixtures with respective physical arrangements of fluorescent lamps and LEDs.
Figure 7:
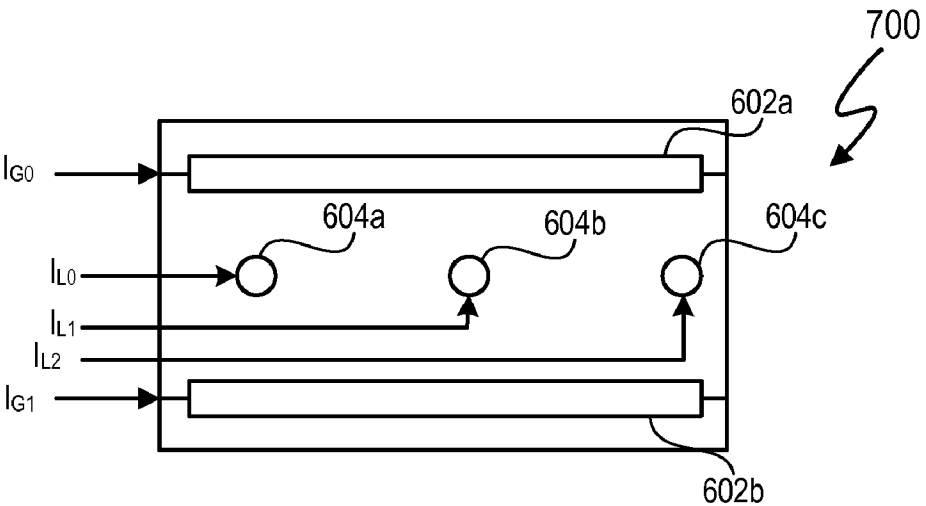

FIGS. 6 and 7 depict respective, exemplary lighting fixtures 600 and 700 with respective physical arrangements of 2 fluorescent lamps 602*a* and 602*b* and 3 LEDs 604*a*, 604*b*, and 604*c*. Control system 212 independently controls gas discharge lamps 602*a* and 602*b* with current drive signals $I_{G0}$ and $I_{G1}$ from light source driver 210. Control system 212 controls LEDs 604*a*, 604*b*, and 604*c* as a group in lighting fixture 600 with current drive signal $I_L$ from light source driver 210. In lighting fixture 700, control system 212 independently controls LEDs 604*a*, 604*b*, and 604*c* with respect current drive signals $I_{L0}$, $I_{L1}$, and $I_{L2}$ from light source driver 210. Allowing more independent control by control system 212 over the light sources in light fixture 212 increases the flexibility of control with the tradeoff of, for example, increased complexity of control system 212 and light source driver 210. The number and type of LEDs and gas discharge lamps is a matter of design choice and depends on, for example, cost, light output, color, and size. In at least one embodiment, the LEDs are disposed within gas discharge lamps.

Thus, in at least one embodiment, the control system 212 can instantaneously provide light output while extending the useful life of each gas discharge lamp and reduce power consumption at low dimming levels.

Although the present invention has been described in detail, it should be understood that various changes, substitutions and alterations can be made hereto without departing from the spirit and scope of the invention as defined by the appended claims. For example, lighting system 200 can include multiple light fixtures, such as light fixture 214, with LED-gas discharge light combinations. The control system 212 and light source driver 210 can be configured to control each of the light fixtures as, for example, described in conjunction with the control of light fixture 212.

What is claimed is:

1. A hybrid gas discharge lamp-light emitting diode (LED) lighting system comprising:

a housing;

an LED retained by the housing;

multiple gas discharge lamps retained by the housing; and a control system coupled to the LED and the gas discharge lamps to dependently operate the LED and at least one of the gas discharge lamps during overlapping, non-identical periods of time, wherein the control system is further configured to (i) coordinate current level adjustment to the LED and the gas discharge lamps to dim the lighting system, (ii) dim the LED and each gas discharge lamp to a first light output level, and (iii) further dim only a subset of the gas discharge lamps to a second light output level, wherein the first light output level is greater than the second light output level.

2. The lighting system of claim 1 wherein the control system is further configured to (i) preheat filaments of the gas discharge lamp for a first period of time prior to causing an arc within the gas discharge lamp, (ii) activate the LED during the first period of time, and (iii) cause an arc within at least one of the gas discharge lamps during a second period of time.

3. The lighting system of claim 2 wherein the control system is further configured to deactivate the LED during at least a portion of the second period of time.

4. The lighting system of claim 1 further comprising:

multiple LEDs retained by the housing; and wherein the control system is further configured to (i) dim each LED and each gas discharge lamp to a first light output level and (ii) further dim only a subset of the gas discharge lamps to a second light output level, wherein the first light output level is greater than the second light output level.

5. The lighting system of claim 1 wherein the second light output level is zero.

6. The lighting system of claim 1 wherein the subset is a proper subset.

7. The lighting system of claim 1 further comprising:

multiple LEDs retained by the housing;

wherein the control system is further configured to decrease current to each gas discharge lamp and increase current to each LED.

8. The lighting system of claim 7 wherein the control system is further configured to decrease current to each gas discharge lamp and, with no more than an insubstantial delay, increase current to each LED and the insubstantial delay is no more than 3 seconds.

9. The lighting system of claim 1 wherein at least one of the gas discharge lamps includes a gas chamber to contain a gas and the LED is contained within the gas chamber.

10. The lighting system of claim 1 wherein at least one of the gas discharge lamps and the LED are coupled separately to the housing.

11. The lighting system of claim 1 wherein at least one of the gas discharge lamps is a fluorescent lamp.

12. The lighting system of claim 1 further comprising:

a power factor correction circuit; and a light source driver coupled to the LED, the gas discharge lamps, the power factor correction circuit, and the control system.

13. A lighting system control system to control a hybrid gas discharge lamp-light emitting diode (LED) lighting system, the control system comprising:

a first output to provide an LED control signal;

a second output to provide a gas discharge lamp control signal;

circuitry to dependently operate at least one LED and multiple gas discharge lamps during overlapping, non-identical periods of time; and an input to receive a dimming signal, wherein the circuitry is further configured to respond to the dimming signal and (i) dim each LED and each gas discharge lamp to a first light output level and (ii) further dim only a subset of the gas discharge lamps to a second light output level, wherein the first light output level is greater than the second light output level.

14. The control system of claim 13 wherein the control system is further configured to (i) warm filaments of the gas discharge lamp for a first period of time prior to causing an arc within the gas discharge lamp, (ii) activate the LED during the first period of time, and (iii) cause an arc within the gas discharge lamp during a second period of time.

15. The control system of claim 14 wherein the control system is further configured to deactivate the LED during at least a portion of the second period of time.

16. The control system of claim 13 further comprising:

an input to receive a dimming signal, wherein the control system is further configured to coordinate current level adjustment to the LED and the gas discharge lamp to dim the lighting system in accordance with the dimming signal.

17. A method of controlling a hybrid gas discharge lamp-light emitting diode (LED), the method comprising:

supplying a control signal to a control system configured to control operation of an LED and gas discharge lamps retained by a housing;

operating the LED and at least one of the gas discharge lamps dependently during overlapping, non-identical periods of time;

coordinating current level adjustment to the LED and the gas discharge lamps to dim the lighting system;

dimming the LED and each gas discharge lamp to a first light output level; and further dimming only a subset of the gas discharge lamps to a second light output level, wherein the first light output level is greater than the second light output level.

18. The method of claim 17 further comprising:

preheating filaments of at least one of the gas discharge lamps for a first period of time prior to causing an arc within at least one of the gas discharge lamps;

activating the LED during the first period of time; and causing an arc within at least one of the gas discharge lamps during a second period of time.

19. The method of claim 18 further comprising:

deactivating the LED during at least a portion of the second period of time.

20. The method of claim 17 further comprising:

coordinating current level adjustment to the LED and at least one of the gas discharge lamps to dim the lighting system.

21. The method of claim 20 wherein the housing further retains multiple LEDs, the method further comprising:

dimming each LED and each gas discharge lamp to the first light output level.

22. The method of claim 20 wherein the housing further retains multiple LEDs and multiple gas discharge lamps, the method further comprising:

decreasing current to each gas discharge lamp and increasing current to each LED.

23. The method of claim 22 further comprising:

decreasing current to each gas discharge lamp and, with no more than an insubstantial delay, increase current to each LED wherein the insubstantial delay is no more than 3 seconds.

24. A hybrid gas discharge lamp-light emitting diode (LED) lighting system comprising:

a housing;

an LED retained by the housing;

a gas discharge lamp retained by the housing; and a control system coupled to the LED and the gas discharge lamp to dependently operate the LED and gas discharge lamp during overlapping, non-identical periods of time, wherein the control system is further configured to (i) preheat filaments of the gas discharge lamp for a first period of time prior to causing an arc within the gas discharge lamp, (ii) activate the LED during the first period of time, and (iii) cause an arc within the gas discharge lamp during a second period of time.

25. The lighting system of claim 24 wherein the control system is further configured to deactivate the LED during at least a portion of the second period of time.

26. A lighting system control system to control a hybrid gas discharge lamp-light emitting diode (LED) lighting system, the control system comprising:

a first output to provide an LED control signal;

a second output to provide a gas discharge lamp control signal; and circuitry to dependently operate at least one LED and at least one gas discharge lamp during overlapping, non-identical periods of time, wherein the circuitry is further configured to (i) warm filaments of the gas discharge lamp for a first period of time prior to causing an arc within the gas discharge lamp, (ii) activate the LED during the first period of time, and (iii) cause an arc within the gas discharge lamp during a second period of time.

27. The control system of claim 26 wherein the circuitry is further configured to deactivate the LED during at least a portion of the second period of time.

28. A method of controlling a hybrid gas discharge lamp-light emitting diode (LED), the method comprising:

supplying a control signal to a control system configured to control operation of an LED and a gas discharge lamp retained by a housing;

operating the LED and gas discharge lamp dependently during overlapping, non-identical periods of time;

preheating filaments of the gas discharge lamp for a first period of time prior to causing an arc within the gas discharge lamp;

activating the LED during the first period of time; and causing an arc within the gas discharge lamp during a second period of time.

29. The method of claim 28 further comprising:

deactivating the LED during at least a portion of the second period of time.

30. A method of controlling a hybrid gas discharge lamp-light emitting diode (LED), wherein a housing retains multiple LEDs and multiple gas discharge lamps, the method comprising:

supplying a control signal to a control system configured to control operation of at least one of the LEDs and at least one of the gas discharge lamps retained by a housing;

operating the LED and at least one of the gas discharge lamps dependently during overlapping, non-identical periods of time;

coordinating current level adjustment to the LED and at least one of the gas discharge lamps to dim the lighting system; and decreasing current to each gas discharge lamp and, with no more than an insubstantial delay, increasing current to each LED wherein the insubstantial delay is no more than 3 seconds.

* * * * *